US005756248A

United States Patent [19]

Tanaka et al.

[11] Patent Number: 5,756,248

[45] Date of Patent: May 26, 1998

[54] ELECTROPHOTOGRAPHIC PHOTOSENSITIVE MEMBER AND APPARATUS AND PROCESS CARTRIDGE PROVIDED WITH THE SAME

[75] Inventors: Takakazu Tanaka, Kawasaki; Toshihiro Kikuchi, Yokohama; Tetsuro Kanemaru, Tokyo; Kouichi Nakata, Yokohama, all of Japan

[73] Assignee: Canon Kabushiki Kaisha, Tokyo, Japan

[21] Appl. No.: 707,672

[22] Filed: Sep. 4, 1996

[30] Foreign Application Priority Data

Sep. 6, 1995 [JP] Japan ..... 7-252023

[51] Int. Cl.[6] ..... G03G 5/09

[52] U.S. Cl. ..... 430/83; 430/59; 430/79; 399/111

[58] Field of Search ..... 430/59, 79, 83

[56] References Cited

U.S. PATENT DOCUMENTS

| | | | |
|---|---|---|---|
| 3,542,546 | 11/1970 | Fox | 430/79 |
| 3,647,432 | 3/1972 | Holstead . | |
| 3,832,172 | 8/1974 | Nishide et al. . | |
| 3,912,509 | 10/1975 | Janssens et al. | 430/79 |
| 4,451,548 | 5/1984 | Kinoshita et al. | 430/79 |
| 4,931,371 | 6/1990 | Matsumoto et al. | 430/59 |
| 5,049,464 | 9/1991 | Kanfmaru et al. | 430/59 |
| 5,098,809 | 3/1992 | Kikuchi et al. | 430/73 |
| 5,145,759 | 9/1992 | Terrell et al. | 430/79 |
| 5,202,207 | 4/1993 | Kanemaru et al. | 430/59 |
| 5,227,271 | 7/1993 | Kikuchi et al. | 430/59 |
| 5,415,962 | 5/1995 | Kanemru et al. | 430/59 |
| 5,510,218 | 4/1996 | Nakata et al. | 430/59 |

FOREIGN PATENT DOCUMENTS

| | | | |
|---|---|---|---|
| 2263815 | 7/1973 | Germany . | |
| 52-4188 | 2/1977 | Japan . | |
| 54-151955 | 11/1979 | Japan . | |
| 55-52063 | 4/1980 | Japan . | |
| 55-42380 | 10/1980 | Japan . | |
| 58-198043 | 11/1983 | Japan . | |
| 62-280850 | 12/1987 | Japan . | |
| 63-13047 | 1/1988 | Japan | 430/79 |
| 3-114058 | 5/1991 | Japan . | |
| 5-53349 | 3/1993 | Japan . | |

*Primary Examiner*—Roland Martin

*Attorney, Agent, or Firm*—Fitzpatrick, Cella, Harper & Scinto

[57] ABSTRACT

An electrophotographic photosensitive member comprising a substrate and a photosensitive layer formed thereon, and the photosensitive layer contains an arylamine compound expressed by the following general formula (1):

(1)

wherein $R_1$ is substituted or unsubstituted alkyl, aralkyl, alkaryl or aryl, $R_2$–$R_8$ are each hydrogen, halogen, substituted or unsubstituted alkyl, alkoxy or amino, and Ar is alkyl, aryl or heterocyclic aryl.

An electrophotographic apparatus includes the electrophotographic photosensitive member set forth above, a charging means, an exposure means, and a developing means.

A process cartridge is formed in which the photosensitive member is integrated with at least one of a charging means, a developing means, and a cleaning means

7 Claims, 1 Drawing Sheet

ELECTROPHOTOGRAPHIC PHOTOSENSITIVE MEMBER AND APPARATUS AND PROCESS CARTRIDGE PROVIDED WITH THE SAME

BACKGROUND OF THE INVENTION

Field of the Invention

The present invention relates to electrophotographic photosensitive members, electrophotographic apparatuses and process cartridges which are provided with the same.

Description of the Related Art

In conventional electrophotographic photosensitive members, inorganic photosensitive members each having a photosensitive layer substantially consisting of zinc oxide and cadmium or the like have been widely used. In such inorganic photosensitive members, however, some problems exist: for example; difficult deposition of the photosensitive layer, poor plasticity, and high production costs. Further, commonly used inorganic photoconductive materials are highly toxic, and thus they must be produced and handled with great care.

Recently, organic photosensitive members substantially consisting of organic photoconductive compounds have been frequently proposed because they not only overcome the problems of the above-mentioned inorganic photosensitive members, but also have additional novel advantages. Some of them have been practically used.

Typical organic photosensitive members include charge-transfer complexes which are formed of photoconductive polymers, e.g. poly-N-vinylcarbazole, and Lewis acids, e.g. 2,4,7trinitro-9-fluorenone. These organic photoconductive compounds have some advantages, such as light weight, and easy film deposition, but at the same time have some disadvantages, such as sensitivity, durability, and stability against environmental changes, as compared with inorganic photoconductive compounds.

Sensitivity and durability have been drastically improved by function-separation-type electrophotographic photosensitive members comprising two materials each material having its own independent function, i.e., charge generating or charge transfer in organic photosensitive members. Because the charge generating materials and charge transfer materials can be widely selected depending upon such-function-separation type electrophotographic photosensitive members, electrophotographic photosensitive members having desired characteristics can be readily prepared.

Examples of charge generating materials conventionally used include various azo pigments, polycyclic quinone pigments, cyanine pigments, squaric acid dyes, and pyrylium salt pigments. Among them, many azo pigments have been proposed due to their excellent light fastness, high charge generating ability, and simple material preparation.

Various charge transfer materials also have been disclosed. For example, pyrazoline compounds are disclosed in Japanese Examined Patent No. 52-4188, hydrazone compounds in Japanese Examined Patent No. 55-42380 and Japanese Laid-Open Patent No. 55-52063, triphenylamine compounds in Japanese Laid-Open Patent Nos. 3-114058 and 5-53349, and stilbene compounds in Japanese Laid-Open Patent Nos. 54-151955 and 58-198043.

In conventional photosensitive members, some cracks occasionally form in the charge transfer layer when the photosensitive member mounted in a copying machine or a laser printer has been not used for a long time. Such cracks cause image defects.

SUMMARY OF THE INVENTION

It is an object of the present invention to provide an electrophotographic photosensitive member, an electrophotographic apparatus and a process cartridge provided with the same, in which no cracks form in the charge transfer layer even after long periods of use.

It is another object of the present invention to provide an electrophotographic photosensitive member, an electrophotographic apparatus and a process cartridge provided with the same, in which high sensitivity and stable electrophotographic characteristics are achieved during repeated operations.

The electrophotographic photosensitive member in accordance with the present invention comprises a substrate and a photosensitive layer formed thereon, and the photosensitive layer contains an arylamine compound expressed by the following general formula (1):

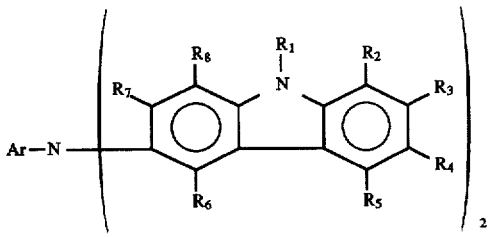

(1)

wherein $R_1$ is substituted or unsubstituted alkyl, aralkyl, alkaryl or aryl, $R_2$–$R_8$ are each hydrogen, halogen, substituted or unsubstituted alkyl, alkoxy or amino, and Ar is alkyl, aryl or heterocyclic aryl.

The electrophotographic apparatus in accordance with the present invention includes the electrophotographic photosensitive member set forth above, a charging means for charging the electrophotographic photosensitive member, an exposure means for exposing an image on the charged electrophotographic photosensitive member to form an electrostatic latent image, and a developing means for developing the electrostatic latent image with a toner.

The process cartridge in accordance with the present invention includes the electrophotographic photosensitive member above integrated with at least one of a charging means, a developing means and a cleaning means.

DETAILED DESCRIPTION OF THE PREFERRED EMBODIMENTS

Figure 1:
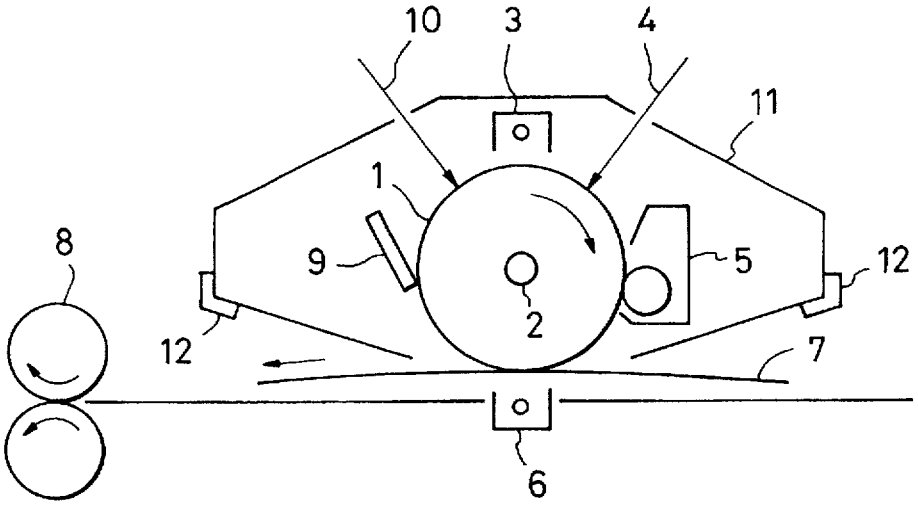
FIG. 1 is a side view illustrating an example of an electrophotographic apparatus using an electrophotographic photosensitive member in accordance with the present invention.

The electrophotographic photosensitive member in accordance with the present invention comprises a substrate and a photosensitive layer formed thereon. The photosensitive layer contains an arylamine compound expressed by the following general formula (1):

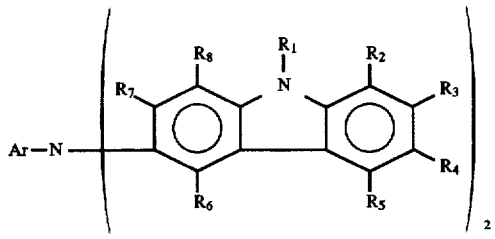

(1)

wherein $R_1$ is substituted or unsubstituted alkyl, aralkyl, alkaryl or aryl, $R_2$–$R_8$ are each hydrogen, halogen, substituted or unsubstituted alkyl, alkoxy or amino, and Ar is alkyl, aryl or heterocyclic aryl.

Each of the alkyl groups represented by $R_1$ through $R_8$, and Ar in the general formula (1) preferably has from one to four carbon atoms. The alkyl groups include methyl, ethyl, propyl, or butyl. The aralkyl group represented by $R_1$ in the general formula (1) is preferably benzyl or phenethyl. The aryl group represented by $R_1$ in the general formula (1) is preferably phenyl, naphthyl or biphenyl. The alkylphenyl group of $R_1$ is preferred. A phenyl group having an alkyl group at a paraposition relative to the nitrogen atom of the carbazole group is more preferable, and the most preferable para-substituted alkyl group is a methyl group.

Each of the halogen atoms represented by $R_2$ through $R_8$ is preferably a fluorine, chlorine or bromine atom. Each of the alkoxyl groups represented by $R_2$ through $R_8$ is preferably a methoxy, ethoxy or propoxy group. The aryl group represented by Ar is preferably a phenyl or naphthyl group. The heterocyclic aryl group represented by Ar is preferably a pyridyl, indolyl or benzothienyl group.

Examples of substituted groups, which can be incorporated in the above-mentioned alkyl, aralkyl, alkaryl, aryl, alkoxy, amino, and heterocyclic aryl groups, include alkyl groups, such as methyl, ethyl, propyl and butyl groups; alkoxy groups, such as methoxy and ethoxy groups; and halogen atoms, such as fluorine, chlorine and bromine.

Examples of preferable aryl amine compounds represented by the general formula (1), but not to limited to, are as follows:

Compound 1 Compound 2

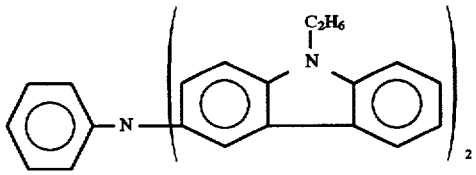

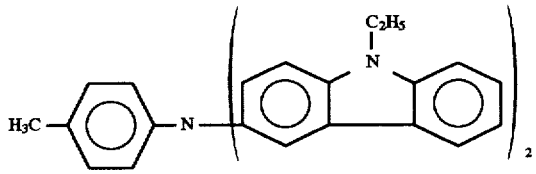

Compound 3 Compound 4

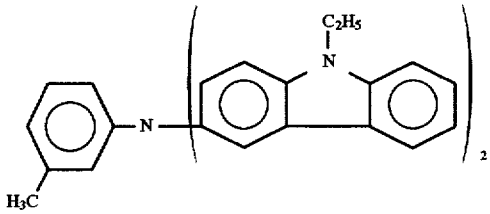

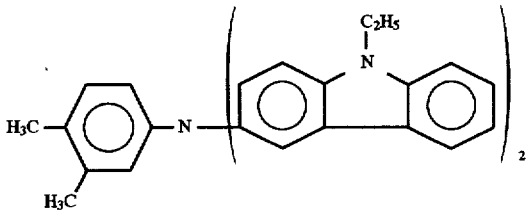

Compound 5 Compound 6

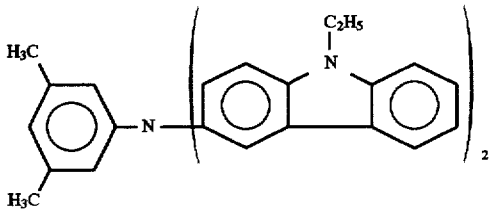

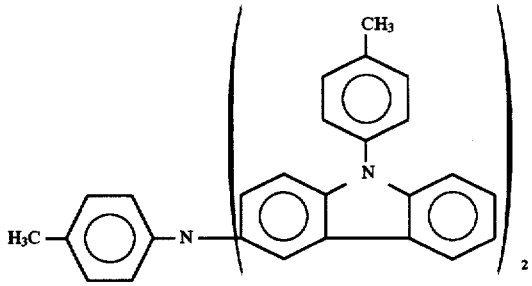

Compound 7 Compound 8

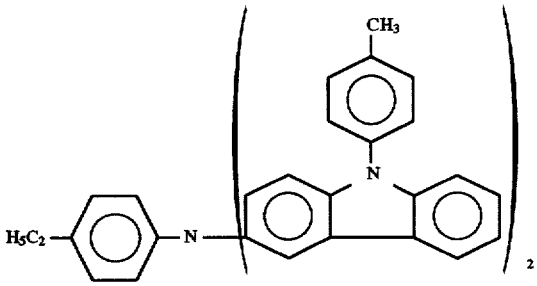

-continued
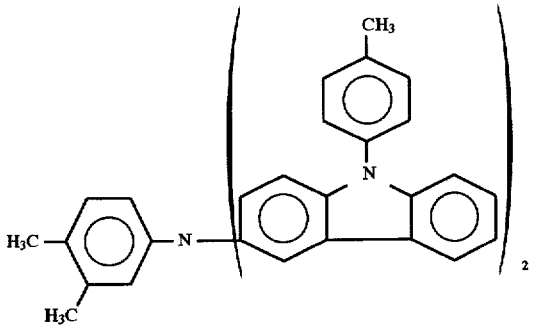
Compound 9 Compound 10
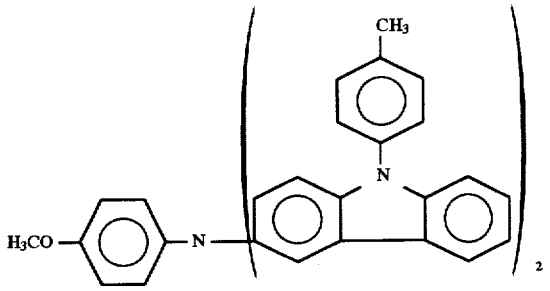
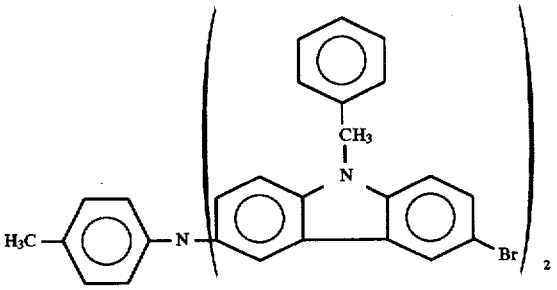
Compound 11 Compound 12
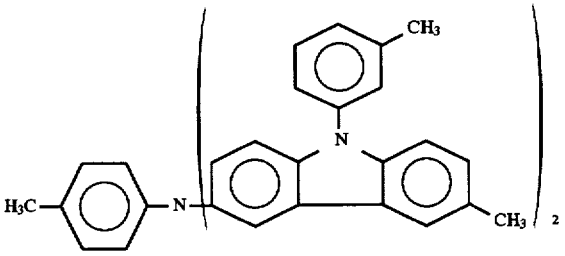
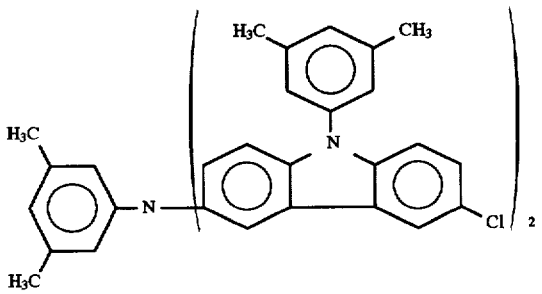
Compound 13 Compound 14
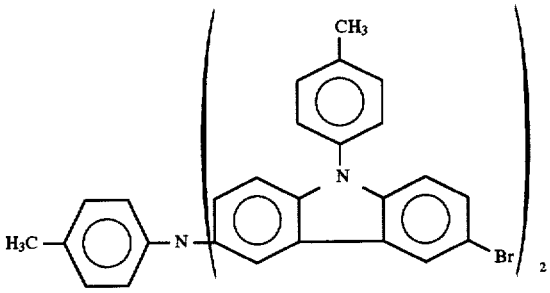
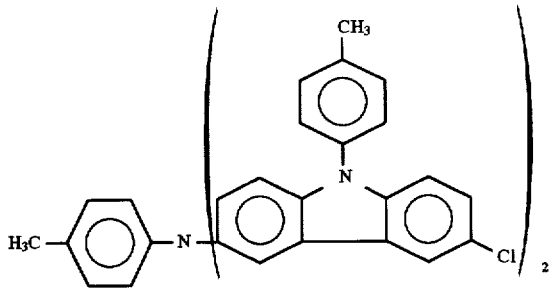
Compound 15 Compound 16
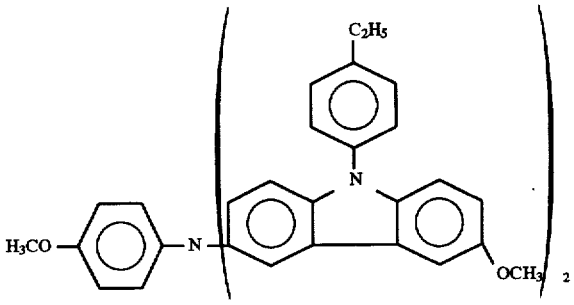
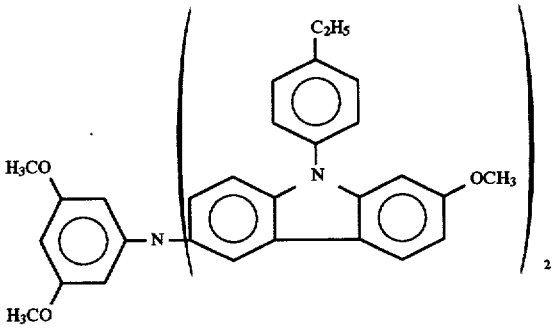
Compound 17 Compound 18
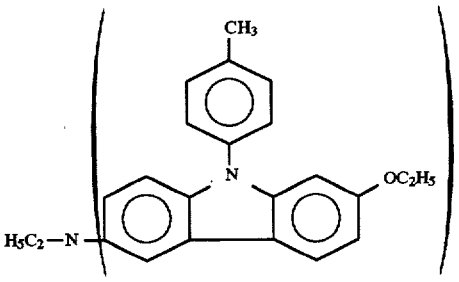

-continued
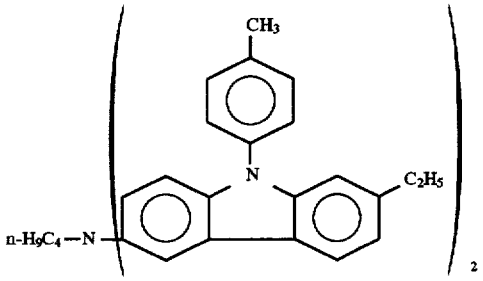
Compound 19 Compound 20
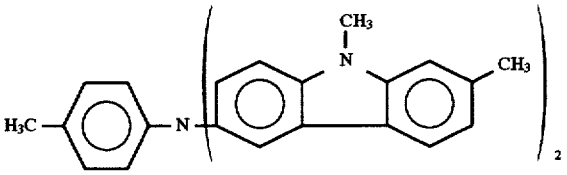
-continued
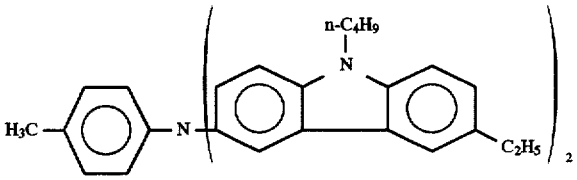
Compound 21 Compound 22
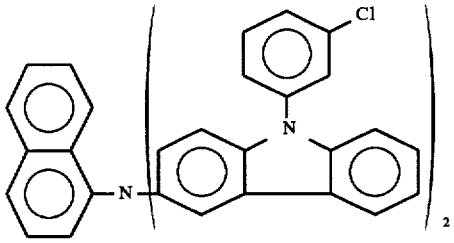
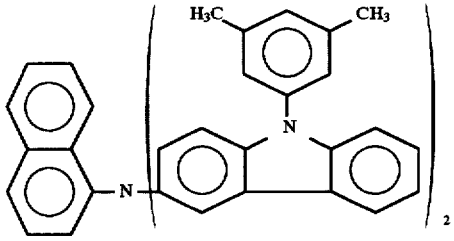
Compound 23
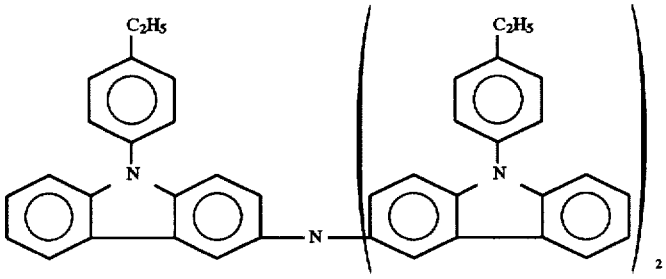
Compound 24
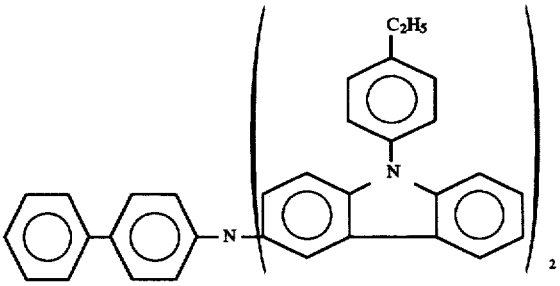

Compound 25
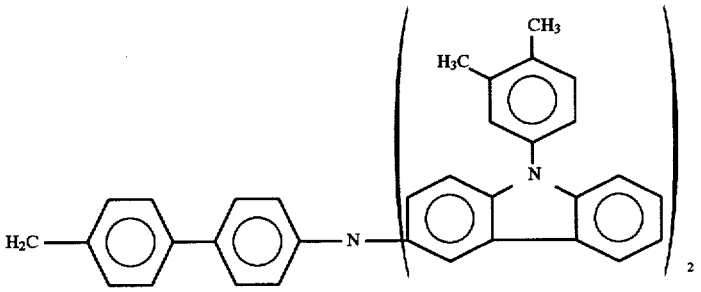
Compound 26
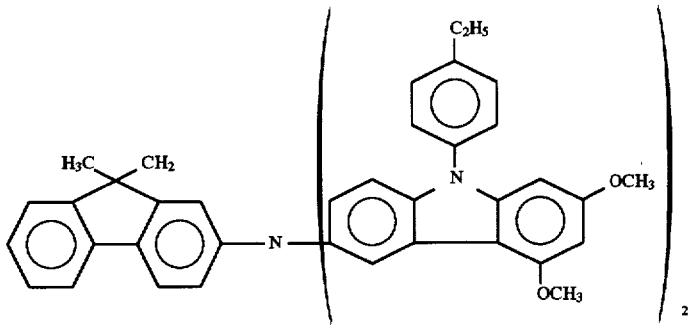
Compound 27 Compound 28
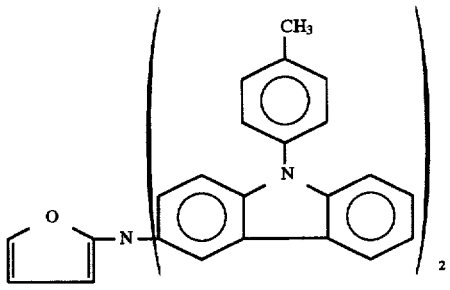
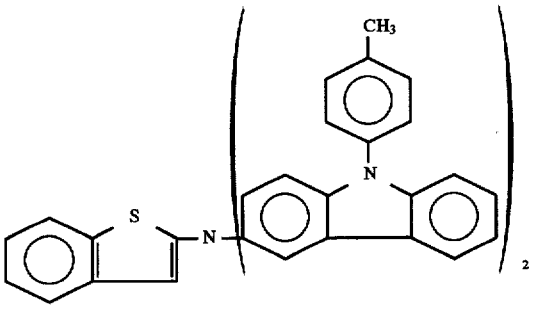
Compound 29 Compound 30
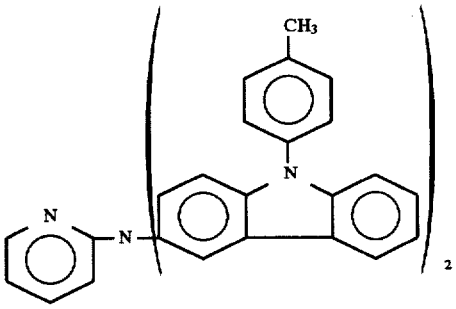
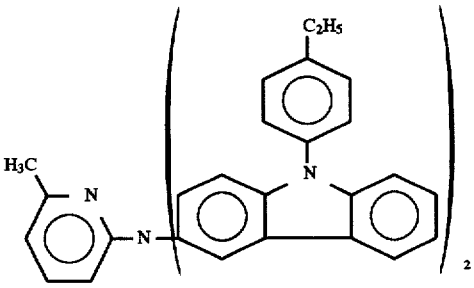

Compound 31 Compound 32

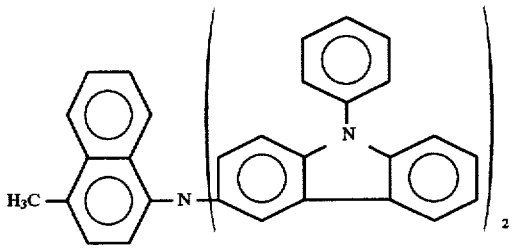

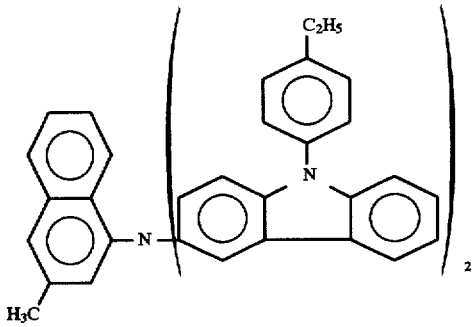

Compound 33

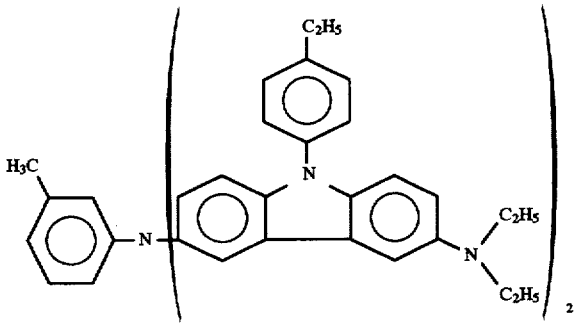

The preferable synthetic procedure for the compounds set forth above is described below.

Synthesis of Compound 2

Into 5.0 g (25.6 mmol) of 9-ethylcarbazole, 40 ml of a 9:1 acetic acid-water mixture, 3.3 g (13.0 mmol) of iodine, 2.5 g of a 30% hydrogen peroxide solution, and 1.8 g of 97% sulfuric acid were added, and the mixture was stirred at 60° C for 2 hours. After natural cooling, the mixture was diluted with water and then extracted with toluene. After the toluene layer was concentrated, the residual component was purified with a silica gel column. As a result, 5.3 g of 3-iodo-9-ethylcarbazole was obtained (corresponding to a 65% yield).

Then, 5 g (15.5 mmol) of the recovered 3-iodo-9-ethylcarbazole, 0.8 g (7.8 mmol) of p-toluidine, 13.8 g of anhydrous potassium carbonate and 3 g of copper powder were added into 50 ml of o-dichlorobenzene, the solution was refluxed for 14 hours with stirring in a nitrogen flow. After natural cooling, the solution was filtered with suction. oDichlorobenzene was removed from the filtrate under reduced pressure. The residual component was purified with a silica gel column. Compound 2 was obtained in an amount of 3.2 g (yield: 42%).

In the electrophotographic photosensitive member in accordance with the present invention the arylamine compound set forth is preferably used as a charge transfer material.

The photosensitive layer structures of the electrophotographic photosensitive member may include the following:

(a) On a substrate, a charge generating layer containing a charge generating material and then a charge transfer layer containing a charge transfer material are separately deposited;

(b) On a substrate, a charge transfer layer and then a charge generating layer are separately deposited;

(c) A layer containing both a charge generating material and a charge transfer material; and (d) On a substrate, a charge generating layer, and then a charge transfer layer containing a charge generating material and a charge transfer material are separately deposited.

Since an arylamine compound in accordance with the present invention has a high transfer characteristic for positive holes, it can be used as a charge transfer material. When the structure of the photosensitive layer is the above (a), negative charging of the instant photosensitive member is preferably used. When the structure is the above (b), positive charge is preferably used; and when the structure is the above (c) or (d), both positive and negative charging are preferably used. Among the structures (a) to (d), the structure (a) is preferably used.

Examples of charge generating materials useful in the electrophotographic photosensitive member of the invention include azo pigments, e.g. monoazo, diazo, and triazo compounds; phthalocyanine pigments, e.g. metal phthalocyanine compounds and non-metal phthalocyanine compounds; indigo pigments, e.g. indigo and thioindigo; polycyclic quinone pigments, e.g. anthraquinone and pyrenequinone; perillene pigments, e.g. perylenic anhydride and imide perylate; squarium pigments; pyrylium and thiopyrylium salts; and triphenylmethane pigments. Charge generating materials in accordance with the present invention also include inorganic materials, such as selenium, selenium-tellurium alloys, and amorphous silicon.

It is preferable in the present invention that titanyl phthalocyanine expressed by the following formula is used as the charge generating material:

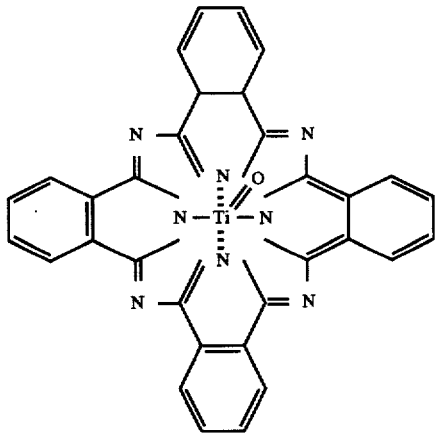

Any of prior art charge transfer materials, as well as the instant arylamine compound, may be included in the photosensitive layer of the present invention.

When the photosensitive layer comprises a single layer, the thickness of the layer preferably ranges from about 5 to 100μm, and more preferably from about 10 to 60 μm. Such a single layer preferably contains from about 10 to 70 weight %, and more preferably from about 20 to 70 weight % of charge generating material and from about 10 to 70 weight %, and more preferably from about 20 to 70 weight % of charge transfer material.

When the photosensitive layer is a laminated layer, the thickness of the charge generating layer preferably ranges from about 0.001 to 5 μm, and more preferably from about 0.01 to 2 μm, and the thickness of the charge transfer layer preferably ranges from about 5 to 40 μm, and more preferably from about 10 to 30 μm. The charge generating layer preferably contains a charge generating material in amounts from about 20 to 100 weight %, and more preferably from about 60 to 100 weight %. The charge transfer layer preferably contains an arylamine compound in accordance with the present invention in an amount from about 10 to 500 parts by weight to 100 parts by weight of a binding resin.

The electrophotographic photosensitive member in accordance with the present invention is prepared by depositing the material used for the photosensitive layer on a substrate. The depositing methods may include vacuum-evaporating, sputtering, CVD, or coating with a suitable binding resin, such as dip coating, spray coating, spinner coating, roll coating, Meyer bar coating, and blade coating.

Non limiting examples of binding resins used in the photosensitive layer (or the charge generating layer and charge transfer layer when the photosensitive layer has a laminated layer) include a variety of binding resins, e.g. polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymeric resins, alkyd resins, epoxy resins, urea resins, and vinyl chloride-vinyl acetate copolymeric resins. These resins can be used alone or in combination. Polyvinyl carbazole and polyvinyl anthracene also can be used as the binding resin in the charge transfer layer.

The substrate can be prepared from the following materials: metals and alloys, such as aluminum, aluminum alloys, titanium; polymers, such as polyethylene terephthalate, polybutylene terephthalate, phenol resins, polypropylene, and polystyrene; and hardened paper. The shape of the substrate is preferably cylindrical, belt-shaped, or sheet. When the volume resistivity of the substrate material is high, a conductive treatment is required. Such a conductive treatment includes depositing a conductive thin film on the substrate, or the dispersion of a conductive material into the substrate.

A protective layer can be provided on the photoconductive layer in accordance with the electrophotographic photoconductive member of the present invention. Such a protective layer substantially consists of a resin. Examples of materials composing the protective layer include polyesters, polyurethanes, polyallylates, polyethylenes, polystyrenes, polybutadienes, polycarbonates, polyamides, polypropylenes, polyimides, polyamide-imide resins, polysulfones, polyarylethers, polyacetals, nylons, phenol resins, acrylic resins, silicone resins, epoxy resins, urea resins, allyl resins, alkyd resins, and butyral resins. The thickness of the protective layer preferably ranges from about 0.05 to 15 μm, and more preferably from about 1 to 10 μm.

An undercoating layer may be provided between the substrate and the photosensitive layer. Such an undercoating layer controls the charge injection at the interface and behaves as an adhesive. The undercoating layer substantially consists of a binding resin and may contain a conductive material and surfactant. Examples of the undercoating layer resins include polyesters, polyurethanes, polyallylates, polyethylenes, polystyrenes, polybutadienes, polycarbonates, polyamides, polypropylenes, polyimides, polyamide-imide resins, polysulfones, polyallyethers, polyacetals, nylons, phenol resins, acrylic resins, silicone resins, epoxy resins, urea resins, allyl resins, alkyd resins, and butyral resins. The thickness of the undercoating layer preferably ranges from about 0.05 to 7 μm, and more preferably from about 0.1 to 2 μm.

Further, the photosensitive layer may contain a sensitizer, an antioxidant, a UV absorber and/or a plasticizer, if necessary.

The electrophotographic apparatus using the process cartridge in accordance with the present invention will now be explained.

In FIG. 1, an electrophotographic photosensitive member 1 in accordance with the present invention rotates along an axis 2 in the direction as shown by the arrow at a predetermined speed. The peripheral surface of the photosensitive member 1 is uniformly charged at a given negative or positive potential with a primary charging means 3 during the rotation, and then is subjected to image exposition 4 from an exposure means (not shown in the figure), such as slit exposure, or laser beam scanning exposure. A latent image is continuously formed on the peripheral surface of the photosensitive member 1. The formed latent image is developed with a toner from a developing means 5 and the developed toner image is transferred to a recording material 7 by a transfer means 6. In transfer means 6, the recording material is fed from a feeding section (not shown in the figure) to a space between the photosensitive member 1 and the transfer means 6 in synchronism with the rotation of the photosensitive member 1. The toner image is transferred to recording material 7 from the surface of the photosensitive member. After the toner image is transferred to the recording material 7 the image is fixed by image fixing means 8. The recording material 7 containing the fixed toner image is delivered out of the apparatus as a copy. The surface of the photosensitive member 1, after the image transfer, is cleaned with cleaning means 9 which removes the residual toner on the surface, is de-electrified by preliminary exposure light 10 from a preliminary exposing means (not shown in the figure), and then is used for the next image formation. When the primary charging means 3 is a contact charging means using a charging roll or the like, the preliminary exposure light is not always necessary.

In the present invention, a plurality of the components selected from the group consisting of the photosensitive member 1, the primary charging means 3, the developing means 5 and the cleaning means 9 are integrated in a process cartridge 11, which can be loaded to and unloaded from the main body of an electrophotographic apparatus, e.g. a copying machine or a laser beam printer. For example, at least one component of the primary charging means 3, the developing means 5 and the cleaning means 9 is integrated with the photosensitive member 1 in process cartridge 11, and process cartridge 11 is loaded to and unloaded from the main body of the apparatus using a guide means, e.g. rails 12 in the main body. In FIG. 1, image exposition 4 represents reflected light or transmitted light from an original document, or the light from a laser, LED or shutter array, driven by signals from the original document.

The electrophotographic photosensitive member in accordance with the present invention is applicable not only to electrophotographic copying machines, but also to applied electrophotographic fields, e.g. laser beam printers, CRT printers, LED printers, liquid crystal printers, and laser plate making processes.

In the electrophotographic photosensitive member in accordance with the present invention, no crack forms in the charge transfer layer after extended use. Additionally, the electrophotographic photosensitive member in accordance with the present invention has a high sensitivity and stable electrophotographic characteristics and suppressed residual potential even after repeated operations. Accordingly, images without defects are obtainable and image quality is barely deteriorated even after repeated image formation in the present invention.

The present invention will now be illustrated by the following representative Examples which are not limitative of scope.

EXAMPLE 1

In a sand mill, 4.6 g of a bis-azo pigment having the following formula and 2 g of a butyral resin (the degree of butyral modification: 65 mole %) in 100 ml cyclohexanone were dispersed for 38 hours to prepare a coating dispersion:

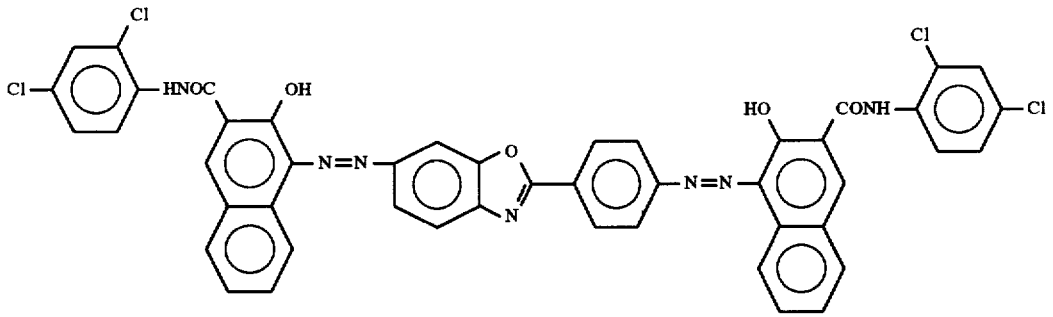

The coating dispersion was coated to form a charge generating layer on an aluminum sheet with a Meyer bar so that the thickness of the coated layer after dryness was 0.3 μm.

Then, 7 g of the arylamine compound, i.e., the above-mentioned Compound 6, as a charge transfer material, and 10 g of a Z-type polycarbonate resin having a weight average molecular weight of 180,000 were dissolved in 70 g of chlorobenzene, the solution was coated on the charge generating layer with a Meyer bar so that the thickness of the charge transfer layer after dryness was 19 μm.

The resulting electrophotographic photosensitive member was corona-charged to −5 KV by a static-method using Kawaguchi Denki K.K. Electrostatic Copying Paper Tester Model-SP-428. After the member was held in a dark place for one second, it was exposed by white light of 20 lux to evaluate its charge characteristics. The charge characteristics were evaluated by a surface potential $V_0$ immediately after charging, a dark decayed potential $V_1$ after one second, and exposure value $E_{1/5}$ necessary to attenuate the surface potential $V_0$ to one-fifth. The results are shown in Table 1.

In order to measure with a commercial machine the variation of light portion potential and dark portion potential when the photosensitive member was repeatedly used, the charge generating layer and the charge transfer layer set forth above were formed on an aluminum cylindrical support having a diameter of 80 mm and a length of 360 mm. The resulting electrophotographic photosensitive member was installed in Canon PPC Copying Machine NP-3825, and then copying operations were repeated 5,000 times to obtain light portion potentials ($V_L$), dark portion potentials ($V_D$), and residual potentials after preliminary exposure ($V_R$), at the initial stage and after 5,000 copying operations, respectively. The initial $V_D$ and $V_L$ were set at −700 V and −200 V, respectively. The results are shown in Table 2.

After the surface of the obtained electrophotographic photosensitive member was touched with a finger, it was left as is for 8 hours at normal temperature and normal pressure. The member was observed to determine whether or not cracks formed on the surface. The results are shown in Table 3.

EXAMPLES 2 to 10

Electrophotographic photosensitive members of Examples 2 to 10 were prepared in a manner identical to Example 1, except that arylamine Compounds 1, 2, 7, 10, 15, 18, 21, 23 and 30 were used as the charge transfer material instead of Compound 6, and a bis-azo pigment having the following formula was used as the charge generating material:

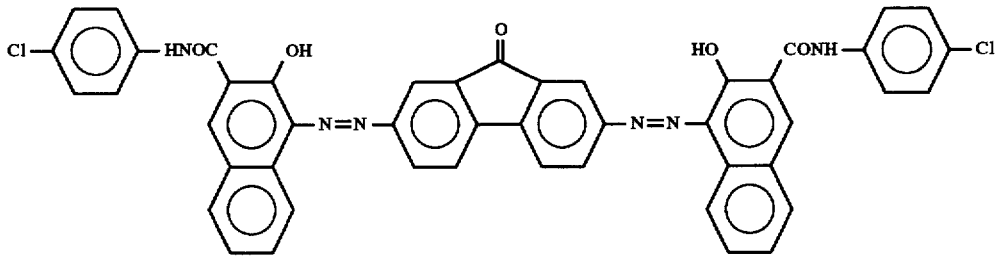

The resulting photosensitive members were evaluated similar to that in Example 1 and the results were reported in Tables 1–3.

TABLE 1

| Example | Arylamine Compound No. | $V_0$ (−V) | $V_1$ (−V) | $E_{1/5}$ (Lx · sec) |
|---|---|---|---|---|
| 1 | 6 | 715 | 705 | 1.4 |
| 2 | 1 | 720 | 710 | 1.8 |
| 3 | 2 | 715 | 703 | 1.3 |
| 4 | 7 | 715 | 705 | 1.4 |

TABLE 1-continued

| Example | Arylamine Compound No. | $V_0$ (−V) | $V_1$ (−V) | $E_{1/5}$ (Lx · sec) |
|---|---|---|---|---|
| 5 | 10 | 720 | 708 | 1.6 |
| 6 | 15 | 710 | 695 | 1.4 |
| 7 | 18 | 705 | 695 | 1.9 |
| 8 | 21 | 710 | 700 | 1.8 |
| 9 | 23 | 705 | 693 | 1.4 |
| 10 | 30 | 715 | 708 | 1.6 |

TABLE 2

| | Initial Characteristics | | | After 5,000 Operations | | |
|---|---|---|---|---|---|---|
| Example | $V_D$ (−V) | $V_L$ (−V) | $V_R$ (−V) | $V_D$ (−V) | $V_L$ (−V) | $V_R$ (−V) |
| 1 | 700 | 200 | 20 | 690 | 210 | 25 |
| 2 | 700 | 200 | 30 | 695 | 205 | 40 |
| 3 | 700 | 200 | 15 | 690 | 205 | 20 |
| 4 | 700 | 200 | 15 | 695 | 200 | 15 |
| 5 | 700 | 200 | 25 | 685 | 195 | 35 |
| 6 | 700 | 200 | 20 | 690 | 205 | 30 |
| 7 | 700 | 200 | 25 | 685 | 215 | 30 |
| 8 | 700 | 200 | 25 | 690 | 220 | 35 |
| 9 | 700 | 200 | 10 | 690 | 230 | 20 |
| 10 | 700 | 200 | 15 | 680 | 210 | 25 |

TABLE 3

| | Cracks on Photosensitive Layer | | | |
|---|---|---|---|---|
| Example | After 1 Hr | After 2 Hrs | After 4 Hrs | After 8 Hrs |
| 1 | None | None | None | None |
| 2 | None | None | None | None |
| 3 | None | None | None | None |
| 4 | None | None | None | None |
| 5 | None | None | None | None |
| 6 | None | None | None | None |
| 7 | None | None | None | None |
| 8 | None | None | None | None |
| 9 | None | None | None | None |
| 10 | None | None | None | None |

Comparative Examples 1 to 4

Electrophotographic photosensitive members were prepared as in Example 1, except that the compounds shown below were used instead of Compound 6. The resulting photosensitive members were evaluated in a manner identical to Example 1. The results are shown in Tables 4 to 6.

Comparative Example 1

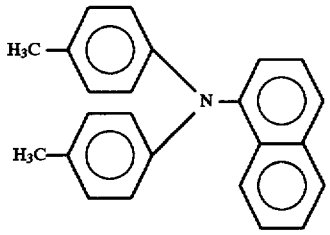

Comparative Example 2

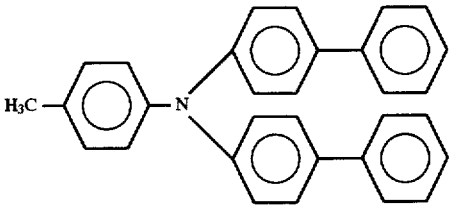

Comparative Example 3

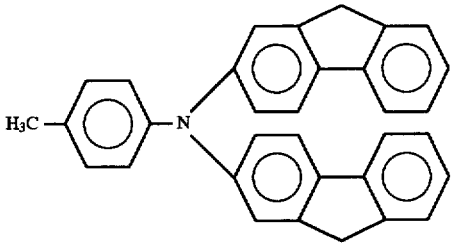

Comparative Example 4

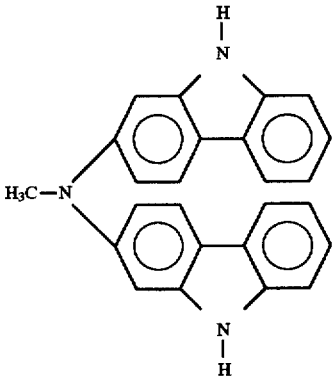

TABLE 4

| Comparative Example | $V_0$ (−V) | $V_1$ (−V) | $E_{1/5}$ (Lx · sec) |
|---|---|---|---|
| 1 | 705 | 690 | 4.6 |
| 2 | 715 | 680 | 4.0 |
| 3 | 705 | 680 | 4.2 |
| 4 | 710 | 685 | 3.7 |

TABLE 5

| | Initial Characteristics | | | After 5,000 Operations | | |
|---|---|---|---|---|---|---|
| Comparative Example | $V_D$ (−V) | $V_L$ (−V) | $V_R$ (−V) | $V_D$ (−V) | $V_L$ (−V) | $V_R$ (−V) |
| 1 | 700 | 200 | 40 | 650 | 350 | 85 |
| 2 | 700 | 200 | 45 | 645 | 310 | 90 |
| 3 | 700 | 200 | 40 | 630 | 300 | 75 |
| 4 | 700 | 200 | 35 | 640 | 290 | 80 |

TABLE 6

| Comparative Example | Cracks on Photosensitive Layer After 1 Hr | After 2 Hrs | After 4 Hrs | After 8 Hrs |
|---|---|---|---|---|
| 1 | None | None | Cracks | Cracks |
| 2 | None | Cracks | Cracks | Cracks |
| 3 | None | None | Cracks | Cracks |
| 4 | None | None | None | Cracks |

Example 11

On an aluminum sheet a solution of 4 g of N-methoxy-modified 6-nylon resin having a weight average molecular weight of 30,000 and 10 g of alcohol-soluble copolymeric nylon resin having a weight average molecular weight of 28,000 dissolved in 100 g of methanol was coated with a Meyer bar to form an undercoat layer, with a dried thickness of 0.8 μm.

Then, 10 g of an azo-bis pigment having the formula below, 5 g of polyvinyl butyral resin (the degree of butyral modification: 68 mole %, weight average molecular weight: 34,000), and 90 g dioxane were dispersed in a ball mill for 24 hours. The dispersion was blade coated to form a charge generating layer on the undercoat layer previously formed, so that the thickness of the layer after dryness was 0.3 μm.

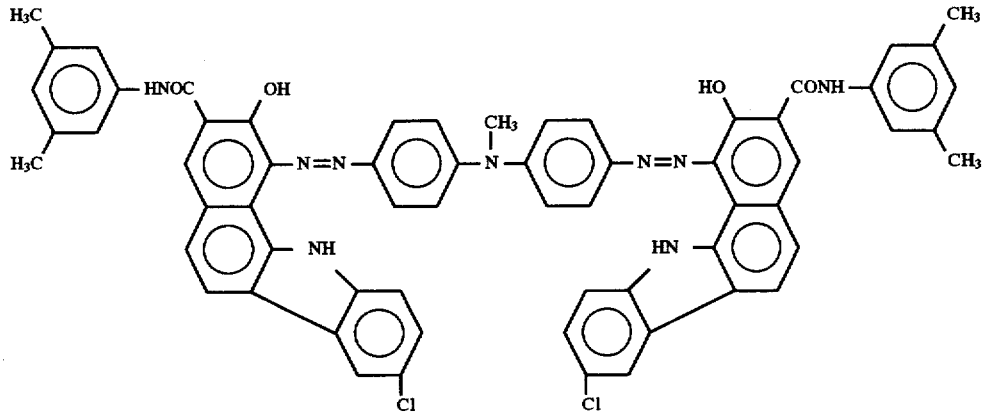

As a charge transfer material, 7 g of the arylamine Compound 3 was employed a solution of the charge transfer material, 10 g of a polymethyl methacrylate resin having a weight average molecular weight of 45,000 and 70 g of chlorobenzene was coated onto the charge generating layer by a coating blade, so that a charge transfer layer having a thickness after drying of 23 μm was formed.

The resulting electrophotographic photosensitive member was corona-charged to −5 KV by a static-method using Kawaguchi Denki K.K. Electrostatic Copying Paper Tester Model-SP-428. After the member was held in a dark place for one second, it was exposed by a laser to evaluate the charge characteristics. The charge characteristics were evaluated by a surface potential $V_0$ immediately after charging, a dark decayed potential $V_1$ after one second, and exposure value $E_{1/5}$ necessary to attenuate the surface potential $V_0$ to one-fifth. The results are as follows:

$V_0$: −715 V, $V_1$: −708 V, and $E_{1/5}$: 2.3 μJ/cm$^2$.

Next, a photosensitive drum, was prepared in a method identical to the electrophotographic photosensitive member of this Example, was installed in a reversal developer type laser beam printer, LBP-CX made by Canon, provided with a semiconductor laser as set forth above, and an image forming test was carried out. The image forming conditions were as follows:

The surface potential after primary charge: −700 V,

The surface potential after image exposure: −150 V (Exposure value: 0.8 μJ/cm$^2$), Transfer potential: +700 V, Polarity in development: Negative, Process Speed: 50 mm/sec., Development bias: −450 V, Scanning after image exposure: Image scanning, and Exposure before primary charge: entire red exposure of 40 lux·sec Image formation was carried out by line-scanning a laser beam in response to character and image signals. Excellent character and image printing was achieved. Further, a stable print quality was maintained after 5,000 continuous copying operations.

EXAMPLE 12

An electrophotographic photosensitive member was prepared in a manner identical to Example 11, but a compound having the formula below was used as a charge generating material.

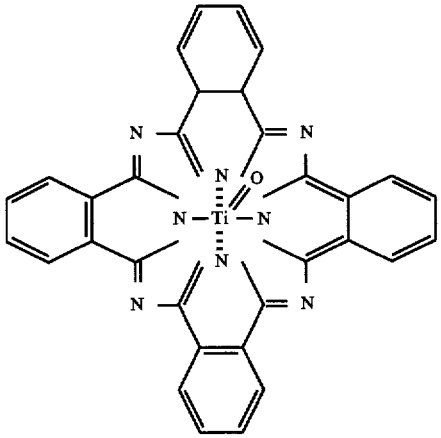

The resulting electrophotographic photosensitive member was evaluated as in Example 11.The results are as follows:

$V_0$: −715 V, $V_i$: −710 V, and $E_{1/5}$: 1.2 μJ/cm$^2$.

In an image forming test similar to that of Example 11, a stable print quality was maintained from the initial stage until 5,000 copying cycles.

While the present invention has been described with reference to what are presently considered to be the preferred embodiments, it is to be understood that the invention is not limited to the disclosed embodiments. To the contrary, the invention is intended to cover various modifications and equivalent arrangements, included within the spirit and scope of the appended claims. The scope of the following claims is to be accorded the broadest interpretation so as to encompass all such modifications and equivalent structures and functions.

What is claimed is:

1. An electrophotographic photosensitive member comprising a substrate and a photosensitive layer formed thereon, said photosensitive layer containing an arylamine compound of the following general formula (1):

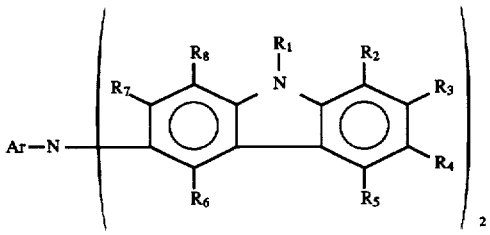

(1)

wherein $R_1$ is a substituted or unsubstituted alkyl, aralkyl, alkaryl or aryl, $R_2$–$R_8$ are each hydrogen, halogen, a substituted or unsubstituted alkyl, alkoxy or amino, and Ar is alkyl, aryl or heterocyclic aryl.

2. An electrophotographic photosensitive member according to claim 1, wherein said alkaryl is alkylphenyl.

3. An electrophotographic photosensitive member according to claim 2, wherein said alkyl of said alkylphenyl is in a para-position on said phenyl relative to the nitrogen atom.

4. An electrophotographic photosensitive member according to claim 3, wherein said alkyl of said alkylphenyl is methyl.

5. An electrophotographic photosensitive member according to claim 1, wherein said photosensitive layer contains a titanyl phthalocyanine having the following formula as a charge generating material:

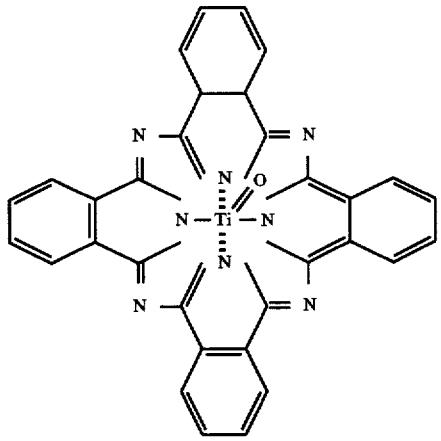

6. An electrophotographic apparatus comprising: in combination, the electrophotographic photosensitive member of claim 1, a charging means for charging said electrophotographic photosensitive member, an exposure means for exposing an image on said charged electrophotographic photosensitive member to form an electrostatic latent image, and a developing means for developing said electrostatic latent image with a toner.

7. A process cartridge comprising: in combination, the electrophotographic photosensitive member of claim 1 integrated with at least one means selected from the group consisting of a charging means, a developing means, and a cleaning means.

* * * * *